US006016037A

United States Patent [19]

Kuribayashi et al.

[11] Patent Number: 6,016,037

[45] Date of Patent: Jan. 18, 2000

[54] ELECTROLUMINESCENCE APPARATUS AND DRIVING METHOD THEREOF

[75] Inventors: Masaki Kuribayashi, Inagi; Yuichi Hashimoto; Akihiro Senoo, both of Tokyo; Kazunori Ueno, Ebina; Hidetoshi Tsuzuki, Yokohama, all of Japan

[73] Assignee: Canon Kabushiki Kaisha, Tokyo, Japan

[21] Appl. No.: 09/089,257

[22] Filed: Jun. 3, 1998

[30] Foreign Application Priority Data

Jun. 11, 1997 [JP] Japan ..... 9-153669

[51] Int. Cl.[7] ..... G09G 3/10

[52] U.S. Cl. ..... 315/169.3; 315/169.2; 345/96; 345/97

[58] Field of Search ..... 315/169.3, 169.1, 315/169.2, 167; 345/94–97; 349/33, 34, 37

[56] References Cited

U.S. PATENT DOCUMENTS

| | | | |
|---|---|---|---|
| 4,356,429 | 10/1982 | Tang | 313/503 |
| 4,769,292 | 9/1988 | Tang et al. | 428/690 |
| 4,776,676 | 10/1988 | Inoue et al. | 350/350 S |
| 4,823,121 | 4/1989 | Sakamoto et al. | 340/781 |
| 4,885,211 | 12/1989 | Tang et al. | 428/457 |
| 4,888,523 | 12/1989 | Shoji et al. | 315/169.3 |
| 4,950,950 | 8/1990 | Perry et al. | 313/504 |
| 5,059,861 | 10/1991 | Littman et al. | 313/503 |
| 5,416,494 | 5/1995 | Yokota et al. | 345/79 |

FOREIGN PATENT DOCUMENTS

| | | |
|---|---|---|
| 0 295 477 | 12/1988 | European Pat. Off. . |
| 6-136360 | 5/1994 | Japan . |
| 6-188074 | 7/1994 | Japan . |
| 6-192654 | 7/1994 | Japan . |
| 6-256759 | 9/1994 | Japan . |
| 8-41452 | 2/1996 | Japan . |
| 8-241048 | 9/1996 | Japan . |
| 2 097 166 | 10/1982 | United Kingdom . |

*Primary Examiner*—Haissa Philogene
*Attorney, Agent, or Firm*—Fitzpatrick, Cella, Harper & Scinto

[57] ABSTRACT

Provided is an electroluminescence apparatus comprising a first unit having a simple matrix electrode structure and an electroluminescence member provided at each intersection between a scanning signal line and an information signal line; and a second unit for sequentially applying a scanning selection signal comprising a first phase and a second phase of mutually different voltage waveforms to the scanning signal line, applying a light emission inducing signal to produce a voltage over a threshold for light emission of the electroluminescence member in synchronism with one of the first phase and the second phase, to the information signal line, and applying a light emission non-inducing signal comprised of a voltage different from that of the light emission inducing signal, in synchronism with the other phase to the information signal line, thereby applying an alternating voltage to the electroluminescence member during a non-selection period of scanning.

26 Claims, 11 Drawing Sheets

○ : LIGHT EMISSION

● : NON-LIGHT EMISSION

ELECTROLUMINESCENCE APPARATUS AND DRIVING METHOD THEREOF

BACKGROUND OF THE INVENTION

1. Field of the Invention

The present invention relates to an electroluminescence apparatus applicable to display devices, light-emitting sources, or printer heads of electrophotographic printers, and a method for driving it. More particularly, the invention relates to an apparatus using organic electroluminescence members suitable for full-color display of large screen, and a method for driving it.

2. Related Background Art

The known organic electroluminescence members are, for example, those disclosed in Japanese Laid-open Patent Applications No. 6-256759, No. 6-136360, No. 6-188074, No. 6-192654, and No. 8-41452.

It is also known that these organic electroluminescence members are driven by thin film transistors, for example, as described in Japanese Laid-open Patent Application No. 8-241048.

For driving the organic electroluminescence members by the thin film transistors, an organic electroluminescence member had to be mounted per drain electrode pad of thin film transistor, however. Particularly, in the case of the full-color display, the electroluminescence members of three kinds for electroluminescence emission of the three primary colors, blue, green, and red, had to be patterned on a thin film transistor substrate. Since the thin film transistor surface had greater unevenness than thin films of the electroluminescence members, it was difficult to pattern the thin films of electroluminescence members in high definition and high density. A further problem was that productivity was low, because the two types of functional devices, the transistors and electroluminescence members, were concentrated on the thin film transistor substrate.

The organic electroluminescence members had a further problem that long-term application of dc voltage thereto shortened continuous emission time. Particularly, when they were driven by the thin film transistors disclosed in Japanese Laid-open Patent Application No. 8-241048 etc., there arose a problem that the dc voltage was continuously applied to the organic electroluminescence members, so as to promote deterioration of the organic electroluminescence members.

SUMMARY OF THE INVENTION

An object of the present invention is to provide an apparatus for simple matrix drive using organic electroluminescence members suitable for full-color display of large screen, solving the above problems, and a driving method thereof.

Another object of the present invention is to provide an electroluminescence apparatus for simple matrix drive capable of continuous emission over the long term, and a driving method thereof.

First, the present invention has the first feature of an electroluminescence apparatus comprising first means having a scanning signal line and an information signal line of wires intersecting with each other, and an electroluminescence member provided at an intersection between the scanning signal line and the information signal line; and second means for sequentially applying a scanning selection signal comprising a first phase and a second phase of mutually different voltage waveforms to the scanning signal line, applying a light emission inducing signal to create a voltage over a threshold for light emission of the electroluminescence member in synchronism with one of the first phase and the second phase, to the information signal line, and applying a light emission non-inducing signal comprised of a voltage different from that of the light emission inducing signal, in synchronism with the other phase to the information signal line, thereby applying an alternating voltage to the electroluminescence member during a non-selection period of scanning.

Second, the present invention has the second feature of an electroluminescence apparatus comprising: first means having a scanning signal line and an information signal line of wires intersecting with each other, and an electroluminescence member provided at an intersection between the scanning signal line and the information signal line; second means for sequentially applying a scanning selection signal comprising a first phase and a second phase of mutually different voltage waveforms to the scanning signal line, applying a light emission inducing signal to create a voltage over a threshold for light emission of the electroluminescence member in synchronism with one of the first phase and the second phase, to the information signal line, and applying a light emission non-inducing signal comprised of a voltage different from that of the light emission inducing signal, in synchronism with the other phase to the information signal line, thereby applying an alternating voltage to the electroluminescence member during a non-selection period of scanning; and third means for setting a voltage waveform of the light emission inducing signal, according to gradation information.

Third, the present invention has the third feature of a driving method for driving an electroluminescence apparatus comprising a scanning signal line and an information signal line of wires intersecting with each other, and an electroluminescence member provided at an intersection between the scanning signal line and the information signal line, said driving method comprising steps of sequentially applying a scanning selection signal comprising a first phase and a second phase of mutually different voltage waveforms to the scanning signal line, applying a light emission inducing signal to create a voltage over a threshold for light emission of the electroluminescence member in synchronism with one of the first phase and the second phase, to the information signal line, and applying a light emission non-inducing signal comprised of a voltage different from that of the light emission inducing signal, in synchronism with the other phase to the information signal line, thereby applying an alternating voltage to the electroluminescence member during a non-selection period of scanning.

Fourth, the present invention has the fourth feature of a driving method for driving an electroluminescence apparatus comprising a scanning signal line and an information signal line of wires intersecting with each other, and an electroluminescence member provided at an intersection between the scanning signal line and the information signal line, said driving method comprising steps of sequentially applying a scanning selection signal comprising a first phase and a second phase of mutually different voltage waveforms to the scanning signal line, applying a light emission inducing signal to create a voltage over a threshold for light emission of the electroluminescence member in synchronism with one of the first phase and the second phase, to the information signal line, applying a light emission non-inducing signal comprised of a voltage different from that of the light emission inducing signal, in synchronism with the other phase to the information signal line, thereby applying an alternating voltage to the electroluminescence member during a non-selection period of scanning, and setting a voltage waveform of the light emission inducing signal, according to gradation information.

BRIEF DESCRIPTION OF THE DRAWINGS

FIGS. 11A, 11B, and 11C are diagrams to show an electroluminescence apparatus used in the present invention, wherein FIG. 11A is a schematic view of an electric system, FIG. 11B is a diagram to show an example of signals, and FIG. 11C is a schematic view of a data converter;

DETAILED DESCRIPTION OF THE PREFERRED EMBODIMENTS

The present invention will be described by reference to the drawings. In the following description electroluminescence will be denoted by "EL."

Figure 1:
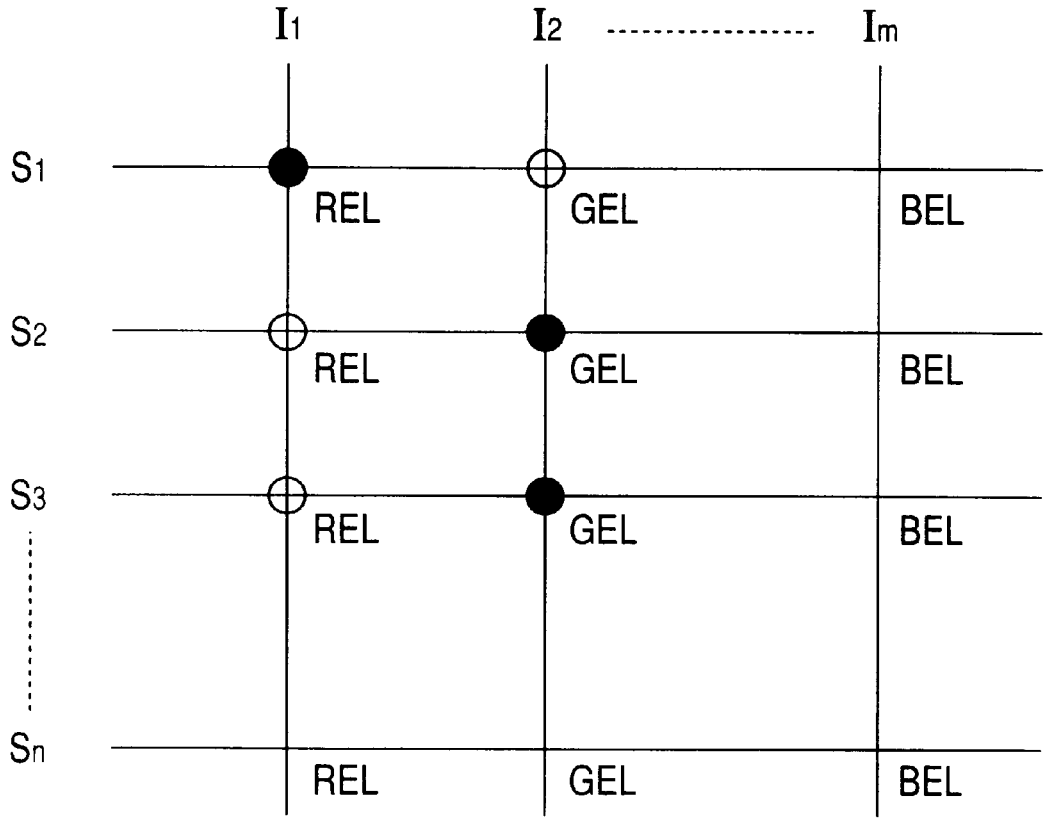
FIG. 1 is a plan view of matrix electrodes used in the present invention.

FIG. 1 illustrates a simple matrix electrode structure used in the present invention. $S_1$, $S_2$, $S_3$ . . . $S_n$ represent n scanning signal lines and $I_1$, $I_2$ . . . $I_m$ m information signal lines. EL devices are located at intersections between these scanning signal lines and information signal lines and produce EL light emission states (white portions) or EL non-light-emission states (black portions) as illustrated, according to image information. In the drawing "REL," "GEL," and "BEL" indicate red light emitting EL devices, green light emitting EL devices, and blue light emitting EL devices, respectively.

Figure 2:
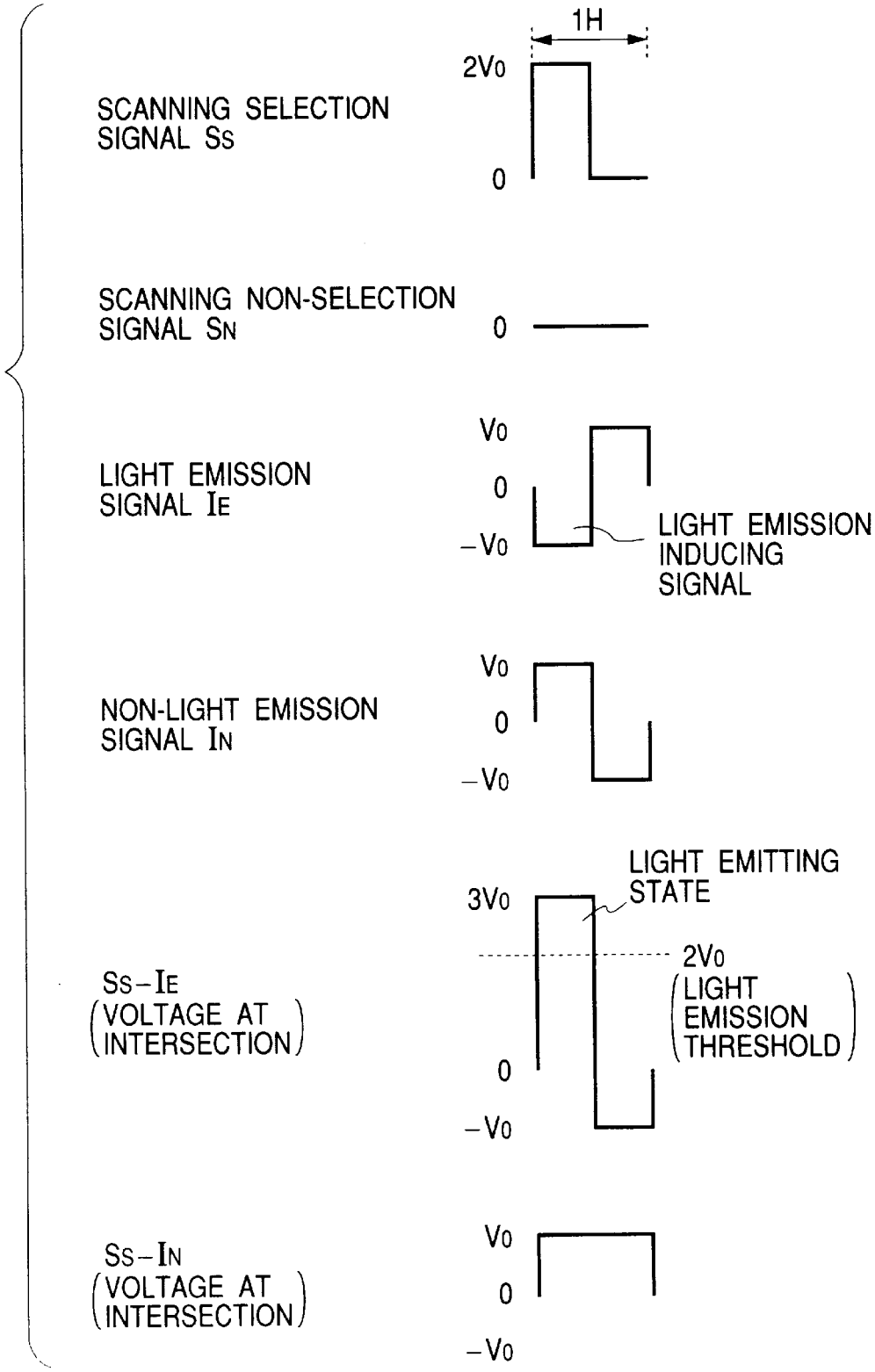
FIG. 2 is a waveform diagram to show an example of driving waveforms used in the present invention.

FIG. 2 shows voltage waveforms of a scanning selection signal and a scanning non-selection signal applied to the scanning signal lines in one horizontal scanning period (1H), and a light emission signal and a non-light-emission signal applied to the information signal lines. The first phase of the scanning selection signal is set to voltage $2V_0$ and the second phase thereof to voltage 0. In this case, the first-phase voltage may be over the voltage $2V_0$. The scanning non-selection signal is set to the voltage 0 in the first phase and the second phase. In this case, a DC component may be added to the voltage 0 in the forward bias direction or in the reverse bias direction. It may also be contemplated that the first-phase voltage is set to the voltage 0 while the second-phase voltage to the voltage $2V_0$. In this case, the light emission signals of FIG. 1 function as non-light-emission signals while the non-light-emission signals as light emission signals.

In the light emission signal a light emission inducing signal of voltage $-V_0$ is set in synchronism with the pulse of voltage $2V_0$ of the first phase in the scanning selection signal, so that the voltage $3V_0$, which is greater than the light emission threshold voltage $2V_0$ in the forward bias direction, is applied to the EL device, thereby producing the light emission state. Further, the light emission signal also includes the voltage $V_0$ applied in synchronism with the voltage 0 of the second phase in the scanning selection signal, so that the voltage $-V_0$ is applied to the EL device on this occasion, thereby producing the non-light-emission state.

When the non-light-emission signal is applied in synchronism with the first-phase voltage and the second-phase voltage of the scanning selection signal, the voltage $V_0$ is applied in either case, thus producing the non-light-emission state.

On the other hand, during application of the scanning non-selection signal (i.e., during a non-selecting period), the EL device receives either the light emission signal or the non-light-emission signal through the information signal line, so that AC voltage, created by the voltage $V_0$ and voltage $-V_0$ forming the light emission signal and the non-light-emission signal, is applied thereto.

Figure 3:
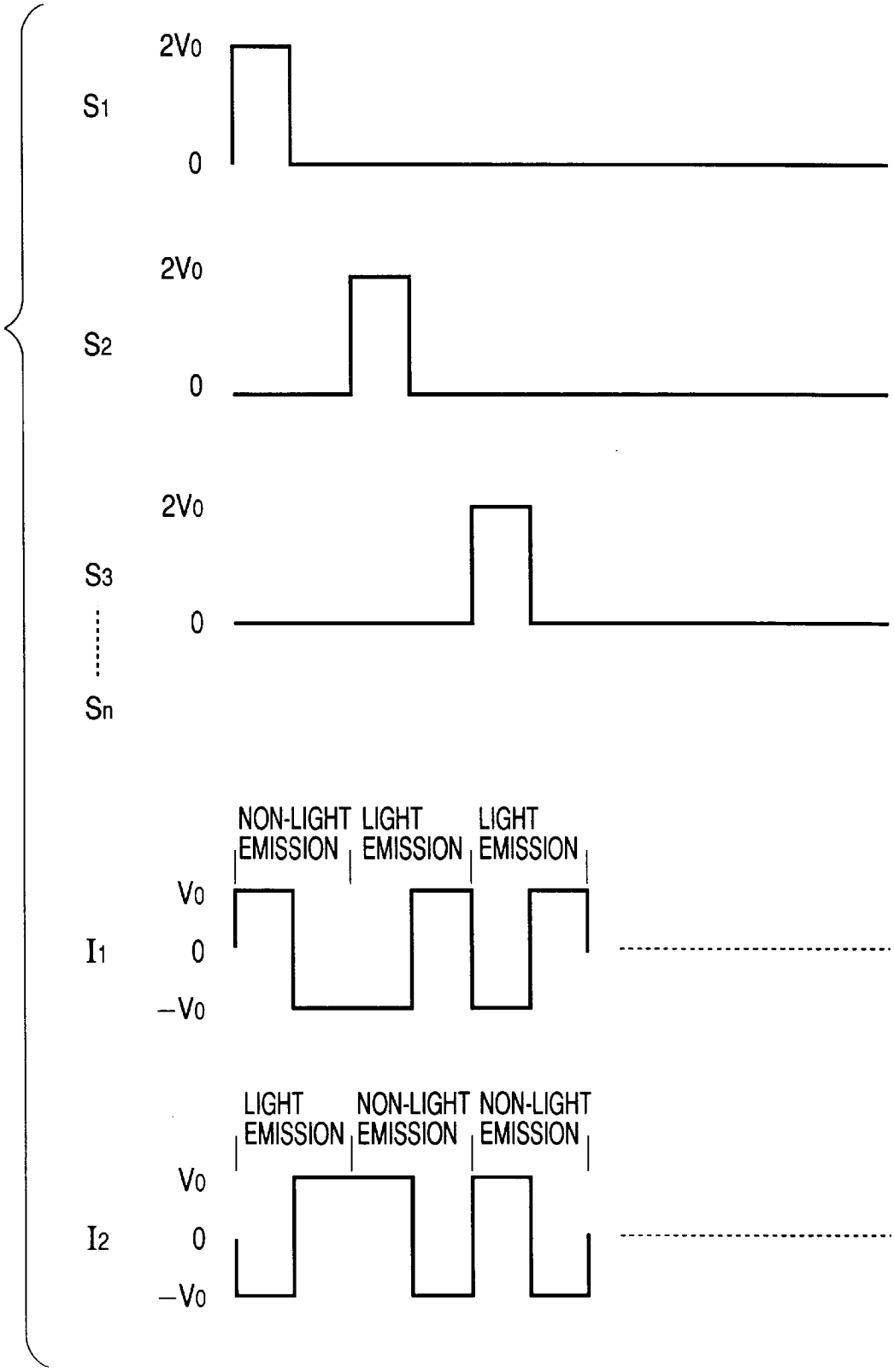
FIG. 3 is a timing chart in use of the driving waveforms of FIG. 2.
Figure 4:
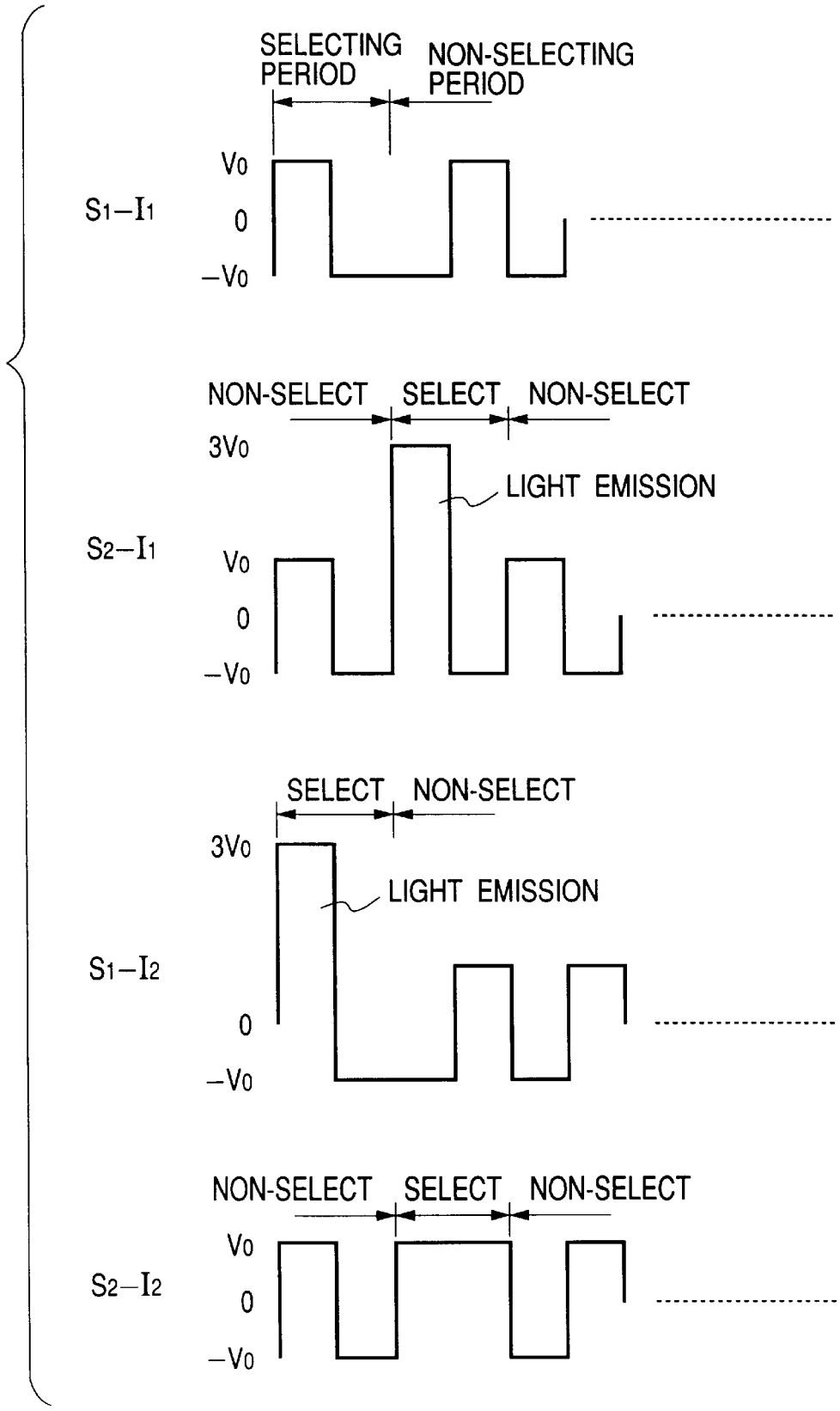
FIG. 4 is a timing chart of applied voltages at EL intersections in use of the driving waveforms of FIG. 2.

FIG. 3 is a timing chart to show the scanning selection signals for generation of the light emission states illustrated in FIG. 1, and the light emission signals and non-light-emission signals. FIG. 4 is a timing chart of voltages applied to the EL device at each intersection in this case, which illustrates states in which the AC voltage, which is below the threshold voltage, is applied to the EL devices during the non-selecting periods.

In the present invention the scanning selection signals described above experience repetitive scanning, thereby carrying out refresh scanning and achieving display of moving picture. On this occasion, the scanning selection signals may be of interlace scanning with interlacing of one signal line or with interlacing of two or more lines, or of non-interlace scanning, for the scanning signal lines.

Figure 5:
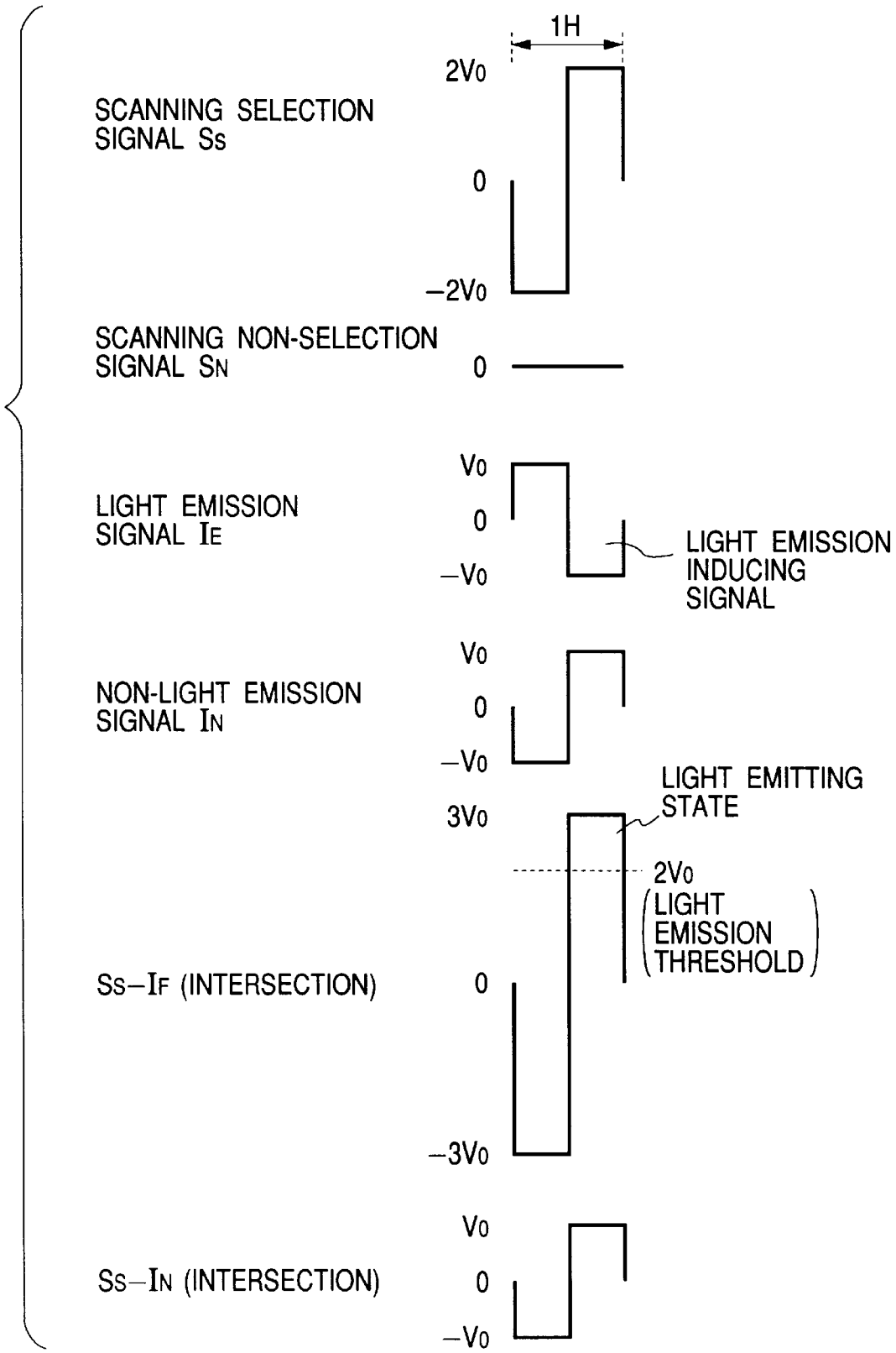
FIG. 5 is a waveform diagram to show another example of driving waveforms used in the present invention.

FIG. 5 shows another embodiment of the present invention, in which the scanning selection signal has the first phase and second phase of voltages having respective polarities opposite to each other. The pulse of the voltage $-2V_0$ of the first phase is adapted to induce a reverse bias for the EL device and can set a time average voltage to 0 with the pulse of the voltage $2V_0$ of the second phase adapted to induce the light emission state for the EL device. This permits the time average of voltage applied to the EL device to be set to 0 throughout the both selecting period and non-selecting period for the EL device. It may also be contemplated that the first-phase voltage is set to the voltage $2V_0$ while the second-phase voltage to the voltage $-2V_0$. In this case, the light emission signal of FIG. 5 functions as a non-light-emission signal and the non-light-emission signal of FIG. 5 as a light emission signal. The scanning selection signal in the above-stated mutually inverse phase relation may be applied using the scanning method for applying the pulses alternately to the scanning signal line every vertical scanning period (one frame scanning period or one field scanning period), or every horizontal scanning period.

In the light emission signal the voltage $V_0$ is set in synchronism with the pulse of the voltage $-2V_0$ of the first phase in the scanning selection signal, so as to achieve non-light-emission. In the second phase of the light emission signal the voltage $-V_0$ is applied in synchronism with the pulse of the voltage $2V_0$, so that the voltage $3V_0$, which is greater than the light emission threshold voltage $2V_0$ in the forward bias direction, is applied to the EL device, thus producing the light emitting state.

When the non-light-emission signal is applied in synchronism with the first-phase voltage and second-phase voltage of the scanning selection signal, the voltages $\pm V_0$ are alternately applied, so as to produce the non-light-emitting state.

On the other hand, during application of the scanning non-selection signal (i.e., during a non-selecting period), the EL device receives either the light emission signal or the non-light-emission signal through the information signal line, so that the AC voltage, created by the voltage $V_0$ and the voltage $-V_0$ forming the light emission signal and the non-light-emission signal, is applied to the EL device.

Figure 6:
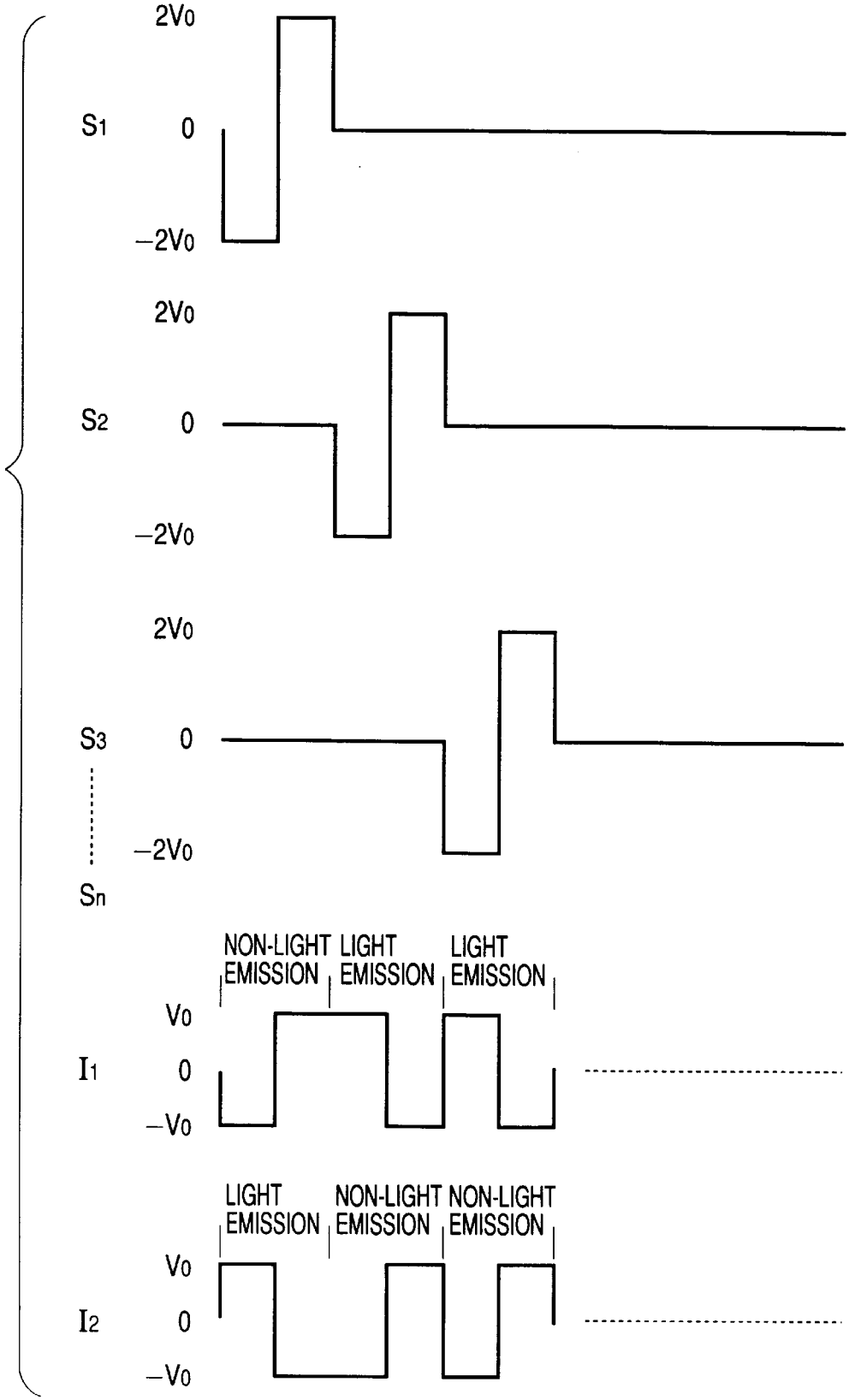
FIG. 6 is a timing chart in use of the driving waveforms of FIG. 5.
Figure 7:
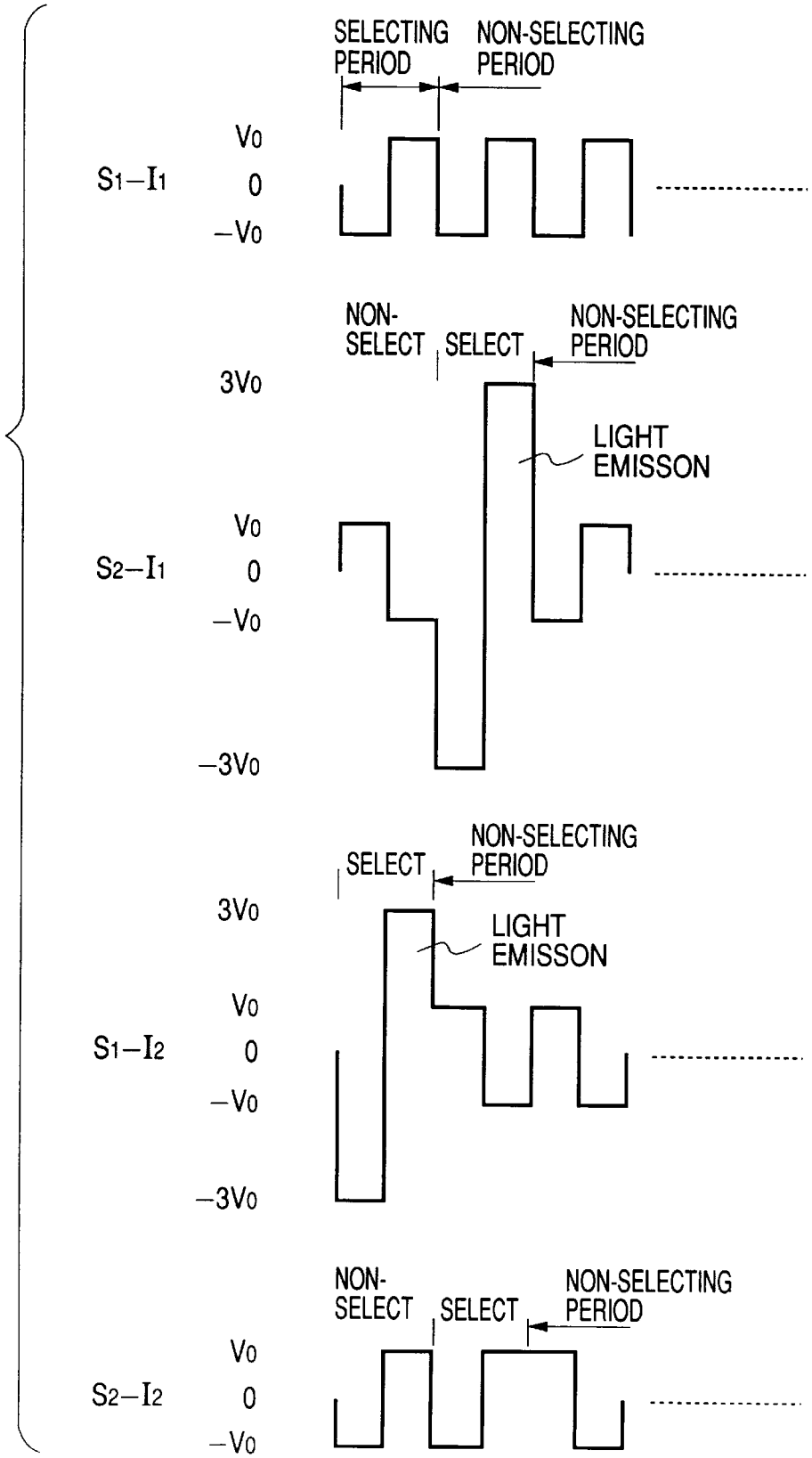
FIG. 7 is a timing chart of applied voltages at EL intersections in use of the driving waveforms of FIG. 5.

FIG. 6 is a timing chart to show the scanning selection signals for production of the light emission states illustrated in FIG. 1, and the light emission signals and non-light-emission signals. FIG. 7 is a timing chart of voltages applied to the EL device at each intersection on this occasion, in which the AC voltage, which is below the threshold voltage, is applied to the EL devices during the non-selecting periods.

Figure 8A:
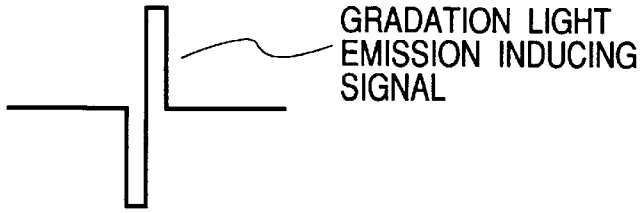
FIGS. 8A, 8B and 8C are diagrams of voltage waveforms for gradation display based on pulse-number change used in the present invention.
Figure 8B:
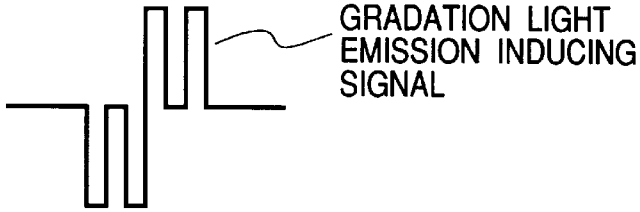
Figure 8C:
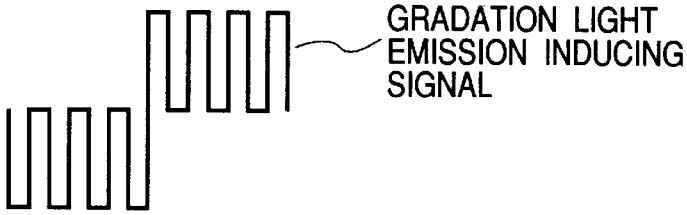
Figure 9A:
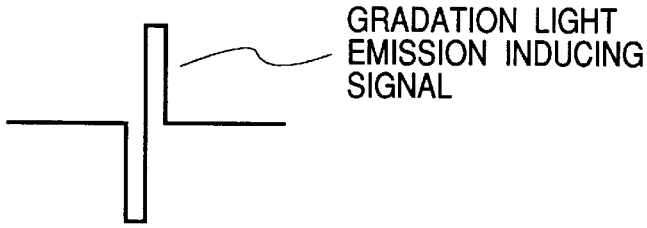
FIGS. 9A, 9B and 9C are diagrams of voltage waveforms for gradation display based on pulse-width change used in the present invention.
Figure 9B:
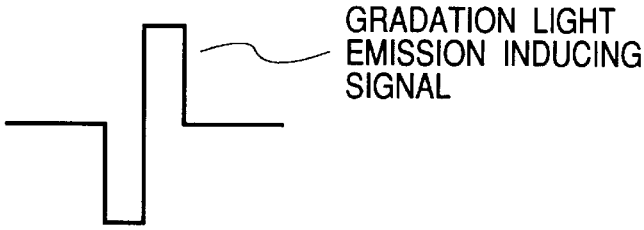
Figure 9C:
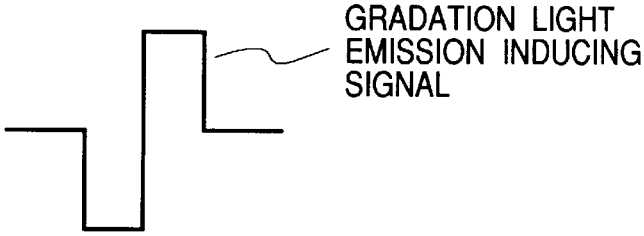
Figure 10A:
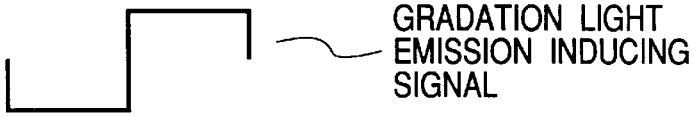
FIGS. 10A, 10B and 10C diagrams of voltage waveforms for gradation display based on pulse-peak-value change used in the present invention.
Figure 10B:
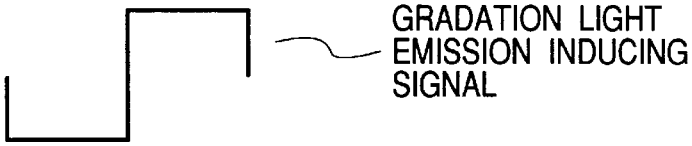
Figure 10C:
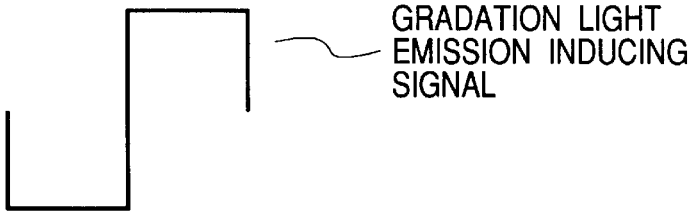

The present invention can realize gradation display by changing the voltage waveform of the above light emission inducing signal, according to gradation information input. Change in the voltage waveform can be achieved, for example, by use of change in the number of pulses as shown in FIGS. 8A, 8B and 8C, change in a pulse width as shown in FIGS. 9A, 9B and 9C, or change in a pulse peak value as shown in FIGS. 10A, 10B and 10C.

Figure 13:
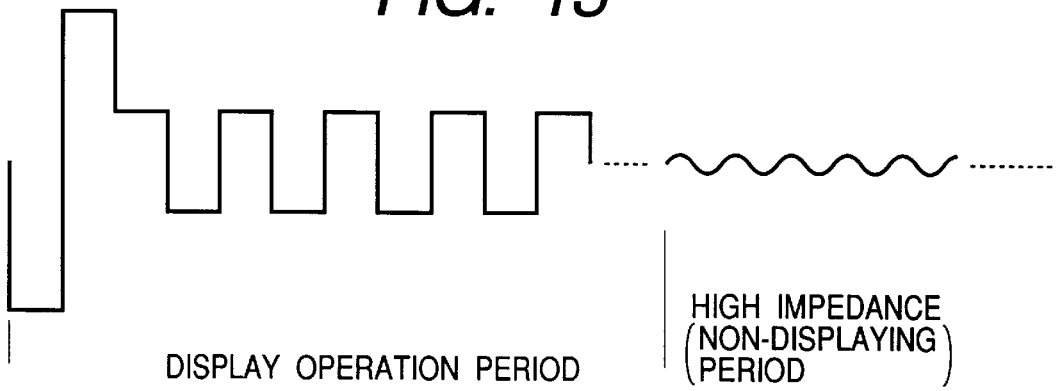
FIG. 13 is a waveform diagram of an embodiment of display operation used in the present invention.
Figure 14:
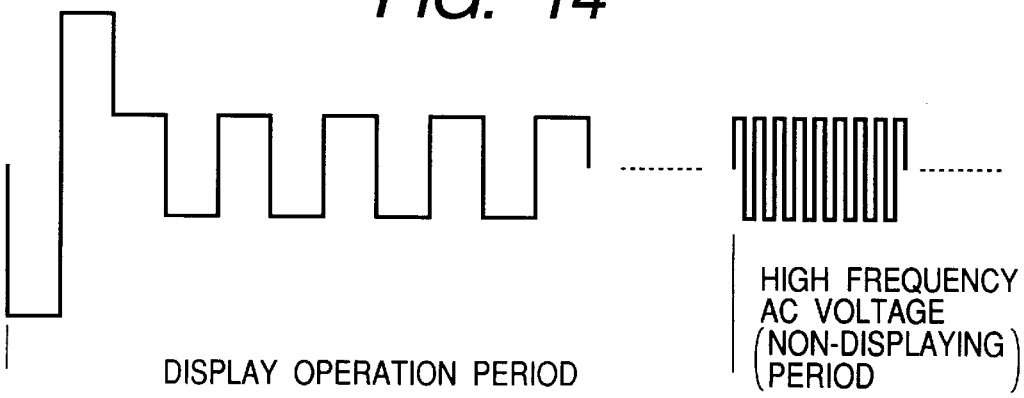
FIG. 14 is a waveform diagram of another embodiment of display operation used in the present invention.

In the present invention, the display operation is interrupted during the period of display operation by refresh scanning of scanning selection signal (the frame frequency of not less than 20 Hz, preferably, not less than 30 Hz), and a pair of electrodes on either side of the EL device are made open as illustrated in FIG. 13, thereby producing a high-impedance state for the EL device during the non-display period; or high-frequency AC voltage (not less than 50 Hz) is placed between a pair of electrodes on either side of the EL device during the non-display period as illustrated in FIG. 14. This extended the light emission life of EL device to a further longer period. Particularly, the high-impedance state or high-frequency AC voltage applying state described above is properly activated while in the display operation there is no change in a display image (for example, while there is no input of character image through a keyboard into a display of a personal computer having a documentation preparation function).

In the present invention, the high-frequency AC voltage (not less than 50 Hz), which is below the light emission threshold voltage, may also be applied in a superimposed manner as a scanning non-selection signal. This extended the light emission life of-EL device to a further longer period.

Figure 11A:
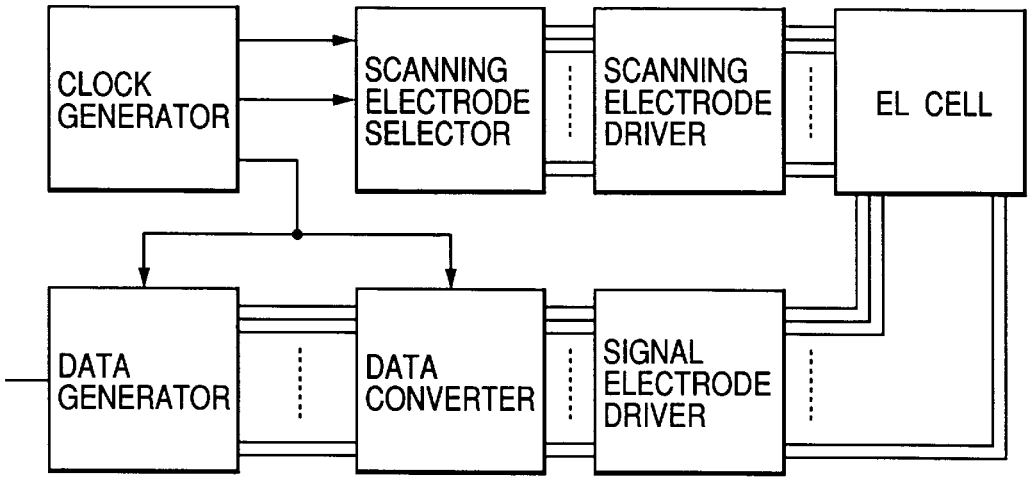

FIG. 11A is a schematic view to show an electric system for driving the EL devices in the driving modes shown in FIGS. 2 to 10A, 10B and 10C. Signals supplied to the scanning electrode group are created by sending clock signals (CS) generated by a clock generator to a scanning electrode selector for selecting scanning electrodes and sending them to a scanning electrode driver.

On the other hand, signals (DM) supplied to the signal electrode group are sent to a data converter capable of forming information signals and auxiliary signals from output signals (DS) from a data generator, and the clock signals (CS), and are further supplied through a signal electrode driver.

Figure 11B:
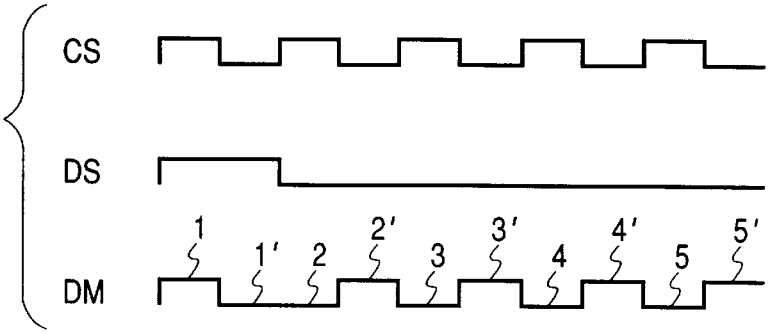

FIG. 11B shows an example of the signals outputted from the above-described data converter, which correspond to the light emission signal and non-light-emission signal in FIGS. 2 to 10A, 10B and 10C based on the aforementioned embodiments.

Figure 11C:
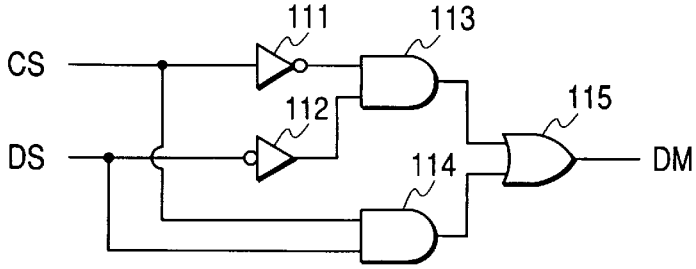

FIG. 11C is a schematic diagram to show the data converter for outputting the signals illustrated in FIG. 11B above. The data converter is composed of two inverters 111 and 112, two AND circuits 113 and 114, and one OR circuit 115.

Figure 12:
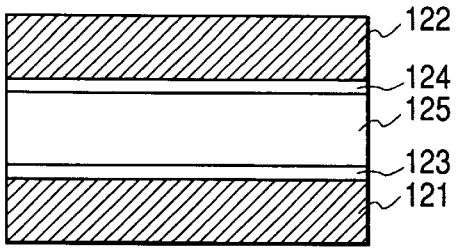
FIG. 12 is a sectional view of an EL device used in the present invention.

FIG. 12 is a sectional view of an EL device used in the present invention. Numerals 121 and 122 designate substrates of glass, plastic, or the like, 123 the cathode, 124 the anode, and 125 EL.

The EL 125 is preferably an organic EL; particularly preferably, one of organic EL devices for full-color emission composed of the red EL (REL), green EL (GEL), and blue EL (BEL) devices.

Specific examples of REL, GEL, and BEL are listed below, but it is noted that the present invention is not intended to be limited to these examples and that inorganic ELs can also be applied instead of the organic ELs.

Materials applicable as the organic ELs in the present invention are those disclosed, for example, in Scozzafava's EPA 349,265 (1990); Tang's U.S. Pat. No. 4,356,429; VanSlyke et al.'s U.S. Pat. No. 4,539,507; VanSlyke et al.'s U.S. Pat. No. 4,720,432; Tang et al.'s U.S. Pat. No. 4,769,292; Tang et al.'s U.S. Pat. No. 4,885,211; Perry et al.'s U.S. Pat. No. 4,950,950; Littman et al.'s U.S. Pat. No. 5,059,861; VanSlyke's U.S. Pat. No. 5,047,687; Scozzafava et al.'s U.S. Pat. No. 5,073,446; VanSlyke et al.'s U.S. Pat. No. 5,059,862; VanSlyke et al.'s U.S. Pat. No. 5,061,617; VanSlyke's U.S. Pat. No. 5,151,629; Tang et al.'s U.S. Pat. No. 5,294,869; Tang et al.'s U.S. Pat. No. 5,294,870. The EL layer is comprised of an organic hole injection and migration zone in contact with the anode, and an electron injection and migration zone which forms a junction with the organic hole injection and migration zone. The hole injection and migration zone can be made of a single material or plural materials and is comprised of the anode, a continuous hole migration layer interposed between a hole injection layer and the electron injection and migration zone, and the hole injection layer in contact therewith. Similarly, the electron injection and migration zone can be made of a single material or plural materials and is comprised of the anode, a continuous electron migration layer interposed between an electron injection layer and the hole injection and migration zone, and the electron injection layer in contact therewith. Recombination of hole and electron and luminescence occurs in the electron injection and migration zone adjacent to the junction between the electron injection and migration zone and the hole injection and migration zone. Compounds forming the organic EL layer are deposited typically by vapor deposition, but they may also be deposited by other conventional technologies.

In a preferred embodiment the organic material of the hole injection layer has the general formula below.

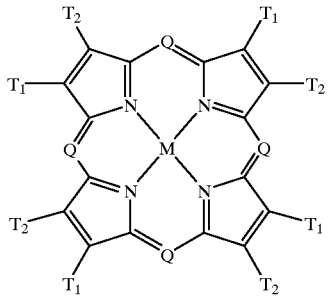

In the above formula, Q represents N or C—R (where R is alkyl such as methyl, ethyl, or propyl, or hydrogen), M is a metal, a metal oxide, or a metal halide, and T1, T2 represent hydrogen or both make up an unsaturated six-membered ring containing a substituent such as alkyl or halogen. A preferred alkyl part contains approximately one to six carbon atoms, while phenyl composes a preferred aryl part.

In a preferred embodiment the hole migration layer is aromatic tertiary amine. A preferred subclass of the aromatic tertiary amine contains tetraaryldiamine having the following formula.

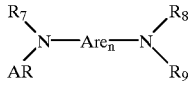

In the above formula Are represents arylene, n an integer from 1 to 4, and Ar, $R_7$, $R_8$, $R_9$ each an aryl group selected. In a preferred embodiment the luminescence, electron injection and migration zone contains a metal oxinoid compound. A preferred example of the metal oxinoid compound has the general formula below.

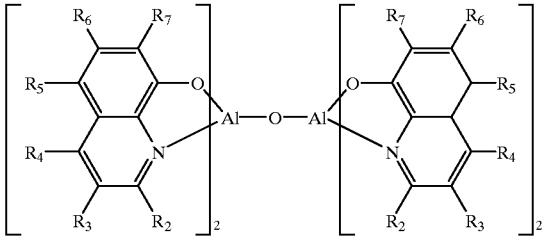

In this formula $R_2$–$R_7$ represent substitutable. In another preferred embodiment the metal oxinoid compound has the following formula.

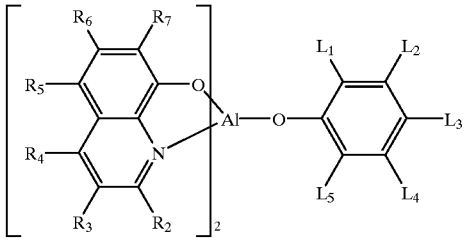

In the above formula $R_2$–$R_7$ are those defined above, and L1–L5 intensively contain 12 or less carbon atoms, each separately representing hydrogen or a carbohydrate group of 1 to 12 carbon atoms, wherein L1, L2 together, or L2, L3 together can form a united benzo ring. In another preferred embodiment the metal oxinoid compound has the following formula.

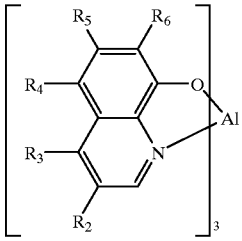

In this formula $R_2$–$R_6$ represent hydrogen or other substitutable. The above examples only represent some preferred organic materials simply used in the electroluminescence layer. Those are not described herein for the intention of limiting the scope of the present invention, but generally indicate the organic electroluminescence layer. As understood from the above examples, the organic EL materials include the coordinate compounds having the organic ligand.

In the next process stage the EL anode 124 is deposited on the surface of device. The EL anode 124 can be made of any electrically conductive material, but it is preferably made of a material having the work function of 4 eV or less (see the Tang's U.S. Pat. No. 4,885,211). Materials having a low work function are preferable for the anode. It is because they readily release electrons into the electron migration layer. Metals having the lowest work function are alkali metals, but instability thereof in the air makes use thereof impractical under certain conditions. The anode material is deposited typically by chemical vapor deposition, but other suitable deposition technologies can also be applied. It was found that a particularly preferred material for the EL anode 124 is a magnesium: silver alloy of 10:1 (in an atomic ratio). Preferably, the anode layer 124 is applied as a continuous layer over the entire surface of display panel. In another embodiment the EL anode 124 is comprised of a lower layer of a metal with a low work function adjacent to the organic electron injection and migration zone, and a protective layer overlaid on the metal with the low work function to protect the metal with the low work function from oxygen and humidity.

Typically the anode material is transparent, while the cathode material is opaque, so that light passes through the anode material. In an alternative embodiment, however, the light radiates through the cathode 123 rather than through the anode 124. In this case the cathode 123 is optically transparent, while the anode 124 is opaque. A practical balance between optical transparency and technological conductivity is typically the thickness in the range of 5–25 nm.

In the present invention the third means preferably has means for setting the number of pulses of the voltage of the light emission inducing signal, according to gradation information.

In the present invention the third means preferably has means for setting a width of a pulse of the voltage of the light emission inducing signal, according to gradation information.

In the present invention the third means preferably has means for setting a peak value of a pulse of the voltage of the light emission inducing signal, according to gradation information.

In the present invention the light emission inducing signal and the light emission non-inducing signal preferably comprise respective voltages of polarities opposite to each other.

In the present invention the first-phase voltage and the second-phase voltage of the scanning selection signal preferably comprise voltages of polarities opposite to each other.

In the present invention the electroluminescence member is preferably an organic electroluminescence member.

In the present invention a threshold for light emission of the electroluminescence member is preferably a threshold voltage of forward bias.

The present invention realizes the light emission of EL device over the long period, particularly the full-color light emission, in the passive matrix drive of high definition and high density.

Further, the present invention realizes the light emission of EL device with gradation components over the long period in the simple matrix drive of high definition and high density.

What is claimed is:

1. An electroluminescence apparatus comprising: first means having a scanning signal line and an information signal line of wires intersecting with each other, and an electroluminescence member provided at an intersection between the scanning signal line and the information signal line; and second means for sequentially applying a scanning selection signal comprising a first phase and a second phase of mutually different voltage waveforms to the scanning signal line, applying a light emission inducing signal to create a voltage over a threshold for light emission of the electroluminescence member in synchronism with one of the first phase and the second phase, to the information signal line, and applying a light emission non-inducing signal comprised of a voltage different from that of the light emission inducing signal, in synchronism with the other phase to the information signal line, thereby applying an alternating voltage to the electroluminescence member during a non-selection period of scanning.

2. The electroluminescence apparatus according to claim 1, wherein said light emission inducing signal and said light emission non-inducing signal comprise respective voltages of polarities opposite to each other.

3. The electroluminescence apparatus according to claim 1, wherein the voltage of the first phase and the voltage of the second phase of said scanning selection signal comprise respective voltages of polarities opposite to each other.

4. The electroluminescence apparatus according to claim 1, wherein said electroluminescence member is an organic electroluminescence member.

5. The electroluminescence apparatus according to claim 1, wherein said threshold for light emission of the electroluminescence member is a threshold voltage of forward bias.

6. The electroluminescence apparatus according to claim 1, wherein said second means comprises means for setting a high impedance state for the electroluminescence member.

7. An electroluminescence apparatus comprising: first means having a scanning signal line and an information signal line of wires intersecting with each other, and an electroluminescence member provided at an intersection between the scanning signal line and the information signal line; second means for sequentially applying a scanning selection signal comprising a first phase and a second phase of mutually different voltage waveforms to the scanning signal line, applying a light emission inducing signal to create a voltage over a threshold for light emission of the electroluminescence member in synchronism with one of the first phase and the second phase, to the information signal line, and applying a light emission non-inducing signal comprised of a voltage different from that of the light emission inducing signal, in synchronism with the other phase to the information signal line, thereby applying an alternating voltage to the electroluminescence member during a non-selection period of scanning; and third means for setting a voltage waveform of the light emission inducing signal, according to gradation information.

8. The electroluminescence apparatus according to claim 7, wherein said third means comprises means for setting the number of pulses of the voltage of the light emission inducing signal.

9. The electroluminescence apparatus according to claim 7, wherein said third means comprises means for setting a width of a pulse of the voltage of the light emission inducing signal.

10. The electroluminescence apparatus according to claim 7, wherein said third means comprises means for setting a peak value of a pulse of the voltage of the light emission inducing signal.

11. The electroluminescence apparatus according to claim 7, wherein said light emission inducing signal and said light emission non-inducing signal comprise respective voltages of polarities opposite to each other.

12. The electroluminescence apparatus according to claim 7, wherein the voltage of the first phase and the voltage of the second phase of said scanning selection signal comprise respective voltages of polarities opposite to each other.

13. The electroluminescence apparatus according to claim 7, wherein said electroluminescence member is an organic electroluminescence member.

14. The electroluminescence apparatus according to claim 7, wherein said threshold for light emission of the electroluminescence member is a threshold voltage of forward bias.

15. The electroluminescence apparatus according to claim 7, wherein said second means comprises means for setting a high impedance state for the electroluminescence member.

16. A driving method for driving an electroluminescence apparatus comprising a scanning signal line and an information signal line of wires intersecting with each other, and an electroluminescence member provided at an intersection between the scanning signal line and the information signal line, said driving method comprising steps of sequentially applying a scanning selection signal comprising a first phase and a second phase of mutually different voltage waveforms to the scanning signal line, applying a light emission inducing signal to create a voltage over a threshold for light emission of the electroluminescence member in synchronism with one of the first phase and the second phase, to the information signal line, and applying a light emission non-inducing signal comprised of a voltage different from that of the light emission inducing signal, in synchronism with the other phase to the information signal line, thereby applying an alternating voltage to the electroluminescence member during a non-selection period of scanning.

17. The driving method of the electroluminescence apparatus according to claim 16, wherein said light emission inducing signal and said light emission non-inducing signal comprise respective voltages of polarities opposite to each other.

18. The driving method of the electroluminescence apparatus according to claim 16, wherein the voltage of the first phase and the voltage of the second phase of said scanning selection signal comprise respective voltages of polarities opposite to each other.

19. A driving method for driving an electroluminescence apparatus comprising a scanning signal line and an information signal line of wires intersecting with each other, and an electroluminescence member provided at an intersection between the scanning signal line and the information signal line, said driving method comprising steps of sequentially applying a scanning selection signal comprising a first phase and a second phase of mutually different voltage waveforms to the scanning signal line, applying a light emission inducing signal to create a voltage over a threshold for light emission of the electroluminescence member in synchronism with one of the first phase and the second phase, to the information signal line, applying a light emission non-inducing signal comprised of a voltage different from that of the light emission inducing signal, in synchronism with the other phase to the information signal line, thereby applying an alternating voltage to the electroluminescence member during a non-selection period of scanning, and setting a voltage waveform of the light emission inducing signal, according to gradation information.

20. The driving method of the electroluminescence apparatus according to claim 19, wherein the number of pulses of the voltage of said light emission inducing signal is set according to said gradation information.

21. The driving method of the electroluminescence apparatus according to claim 19, wherein a width of a pulse of the voltage of said light emission inducing signal is set according to said gradation information.

22. The driving method of the electroluminescence apparatus according to claim 19, wherein a peak value of a pulse of the voltage of said light emission inducing signal is set according to said gradation information.

23. The driving method of the electroluminescence apparatus according to claim 19, wherein said light emission inducing signal and said light emission non-inducing signal comprise respective voltages of polarities opposite to each other.

24. The driving method of the electroluminescence apparatus according to claim 19, wherein the voltage of the first phase and the voltage of the second phase of said scanning selection signal comprise respective voltages of polarities opposite to each other.

25. The driving method of the electroluminescence apparatus according to claim 19, wherein said electroluminescence member is an organic electroluminescence member.

26. The driving method of the electroluminescence apparatus according to claim 19, wherein said threshold for light emission of the electroluminescence member is a threshold voltage of forward bias.

* * * * *